US008847134B2

(12) United States Patent
Gaudette

(10) Patent No.: US 8,847,134 B2
(45) Date of Patent: Sep. 30, 2014

(54) DEPLOYABLE WING AND FIN CONTROL SURFACE ACTUATION

(75) Inventor: Michael Gaudette, Canyon Country, CA (US)

(73) Assignee: Lockheed Martin Corporation, Bethesda, MD (US)

( * ) Notice: Subject to any disclaimer, the term of this patent is extended or adjusted under 35 U.S.C. 154(b) by 225 days.

(21) Appl. No.: 13/398,773

(22) Filed: Feb. 16, 2012

(65) Prior Publication Data

US 2013/0214085 A1 Aug. 22, 2013

(51) Int. Cl.
*F42B 15/01* (2006.01)
*F42B 10/64* (2006.01)

(52) U.S. Cl.
CPC ..... *F42B 10/64* (2013.01)
USPC ..... 244/3.24; 244/3.27

(58) Field of Classification Search
USPC ..... 244/3.24, 3.27–3.29
See application file for complete search history.

(56) References Cited

U.S. PATENT DOCUMENTS

| | | | | |
|---|---|---|---|---|
| 2,712,421 | A | 7/1955 | Naumann | |
| 3,650,496 | A | 3/1972 | Svensson | |
| 4,575,025 | A | 3/1986 | Sadvary et al. | |
| 6,186,443 | B1 | 2/2001 | Shaffer | |
| 6,220,551 | B1 | 4/2001 | Saiz | |
| 6,581,871 | B2 * | 6/2003 | Pijaca et al. | 244/3.27 |
| 7,665,690 | B2 | 2/2010 | Sheahan, Jr. et al. | |
| 2003/0178526 | A1 * | 9/2003 | Banks et al. | 244/3.24 |
| 2011/0101170 | A1 | 5/2011 | Mabe et al. | |
| 2012/0210901 | A1 * | 8/2012 | Bender | 102/374 |

FOREIGN PATENT DOCUMENTS

| | | | |
|---|---|---|---|
| EP | 1 628 112 | A1 | 2/2006 |
| GB | 2 323 577 | A | 9/1998 |
| WO | WO 2005/101154 | A1 | 10/2005 |

* cited by examiner

*Primary Examiner* — Tien Dinh
*Assistant Examiner* — Nicholas McFall
(74) *Attorney, Agent, or Firm* — McDermott Will & Emery LLP

(57) ABSTRACT

A system for actuating a control surface of a deployable member is provided. The system includes an actuator disposed within a fuselage structure of a missile; a double joint having a distal end for connecting to the actuator and a proximal end for engaging the control surface, wherein the double joint further includes a first and second pivot; and a mechanical brake configured to controllably prevent rotation of the actuator.

10 Claims, 7 Drawing Sheets

DEPLOYABLE WING AND FIN CONTROL SURFACE ACTUATION

STATEMENT AS TO RIGHTS TO INVENTIONS MADE UNDER FEDERALLY SPONSORED RESEARCH OR DEVELOPMENT

Not Applicable.

FIELD

The present invention generally relates to missile control surface actuation and, in particular, relates to deployable wing and fin control surface actuation.

BACKGROUND

A supersonic missile may require a moveable flight control surface, such as an elevon or rudder, to control the flight path of the missile. The flight control surface may also be part of a deployable wing or fin, further complicating actuation of the flight control surface. Contrary to subsonic variants, for supersonic missiles, an actuator cannot be housed within the wing or fin because supersonic speed requirements do not tolerate the additional drag caused by housing the actuator within the wing or fin. In addition, the heat generated by the supersonic speed exceeds most actuator limitations and thus, would require additional thermal shielding further increasing drag, weight, and consumption of volume within the wing or fin.

SUMMARY

The following presents a simplified summary of one or more embodiments in order to provide a basic understanding of such embodiments. This summary is not an extensive overview of all contemplated embodiments, and is intended to neither identify key or critical elements of all embodiments nor delineate the scope of any or all embodiments. Its sole purpose is to present some concepts of one or more embodiments in a simplified form as a prelude to the more detailed description that is presented later.

According to various aspects of the subject technology, systems and methods are provided for actuating a control surface of a deployable wing or a fin. In one aspect, an actuator is disposed within a fuselage structure of a missile, thereby thermally shielding the actuator, minimally impacting drag, and minimizing weight. In another aspect, the system is capable of withstanding high temperatures and thermal expansion of the control surface, wing, and/or fin, without inhibiting actuation of the control surface. In some aspects, a double joint maintains an alignment of the control surface with respect to the deployable wing or fin during deployment.

In accordance with one aspect of the subject technology, a system for actuating a control surface of a deployable member is provided. The system comprises an actuator disposed within a fuselage structure of a missile; a double joint comprising a distal end for connecting to the actuator and a proximal end for engaging the control surface, wherein the double joint further comprises a first and second pivot; and a mechanical brake configured to controllably prevent rotation of the actuator.

According to another aspect of the subject technology, a method for actuating a control surface of a deployable member is provided. The method comprises disposing an actuator within a fuselage structure of a missile; and connecting the actuator to the control surface by using a double joint, wherein the double joint comprises a first and second pivot. The method also comprises moving the deployable member and the control surface from a stowed position to a deployed position; and maintaining an alignment between the deployable member and the control surface during the deployment. The method further comprises accommodating for any misalignment that may occur between the control surface and the deployable member as a result of thermal expansion, bending, or deflection by using the first and second pivot of the double joint; and actuating the control surface with the actuator.

Additional features and advantages of the subject technology will be set forth in the description below, and in part will be apparent from the description, or may be learned by practice of the subject technology. The advantages of the subject technology will be realized and attained by the structure particularly pointed out in the written description and claims hereof as well as the appended drawings.

It is to be understood that both the foregoing general description and the following detailed description are exemplary and explanatory and are intended to provide further explanation of the invention as claimed.

BRIEF DESCRIPTION OF THE DRAWINGS

The accompanying drawings, which are included to provide further understanding of the subject technology and are incorporated in and constitute a part of this specification, illustrate aspects of the subject technology and together with the description serve to explain the principles of the subject technology.

DETAILED DESCRIPTION

In the following detailed description, numerous specific details are set forth to provide a full understanding of the subject technology. It will be apparent, however, to one ordinarily skilled in the art that the subject technology may be practiced without some of these specific details. In other instances, well-known structures and techniques have not been shown in detail so as not to obscure the subject technology. Like components are labeled with identical element numbers for ease of understanding.

Various aspects of the subject technology provide a system and method for actuating a control surface of a deployable member, which may comprise a deployable wing or a deployable fin. In one aspect, an actuator is disposed within a fuselage structure of a missile, thereby thermally shielding the actuator, minimally impacting drag, and minimizing weight. In another aspect, the system is capable of withstanding high temperatures and thermal expansion of the control surface, wing, and/or fin, without inhibiting actuation of the control surface.

Figure 1:
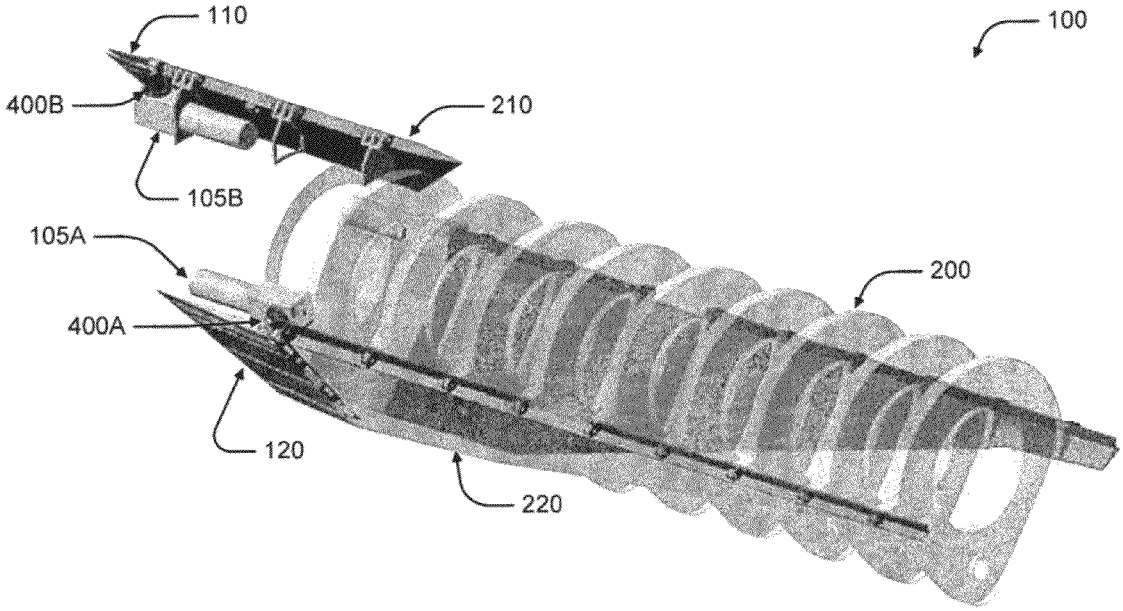
FIG. 1 illustrates a missile having a deployable wing and fin in a stowed position, in accordance with various aspects of the subject technology.

FIG. 1 illustrates a supersonic missile, in accordance with various aspects of the subject technology. In one aspect, the supersonic missile may be configured to travel at supersonic speeds, generally at a speed above Mach 1, and thereby experience high temperatures of about 650° F. or more, which require the use of exotic materials and/or metals such as Titanium or Inconel.

In some aspects, the missile may have a fuselage structure 200, a deployable wing 220, an elevon 120, a deployable fin 210, and a rudder 110. The elevon 120 and the rudder 110 may serve as control surfaces for the deployable wing 220 and fin 210, respectively. FIG. 1 shows the deployable wing 220 and the fin 210 in a stowed position. In some aspects, actuation of the control surfaces 110, 120 may be achieved by a system 100 comprising actuators 105A and 105B, double joints 400A and 400B, and a mechanical brake integral within the actuator, as further discussed below.

In some aspects, each actuator 105A and 105B may comprise an electromechanical rotary or linear actuator configured to rotate a control surface of a missile about +/−30 degrees about a hinge axis. For instance, a linear actuator, such as a ballscrew, may be configured to actuate the control surface of the missile via a bellcrank. In the example shown in FIG. 1, actuator 105A comprises a rotary actuator configured to actuate the elevon 120, and actuator 105B comprises a rotary actuator configured to actuate the rudder 110. Each actuator 105A and 105B may be configured to generate about 3200 in-lbs of torque and may have an upper temperature limit of 400° F. In various aspects, to prevent each actuator 105A and 105B from exceeding the upper temperature limit, each actuator 105A and 105B may be disposed within the fuselage structure 200 of the missile. By disposing each actuator 105A and 105B within the fuselage structure 200, each actuator is thermally insulated and shielded without increasing the drag or weight of the wing 220 or fin 210.

Figure 2:
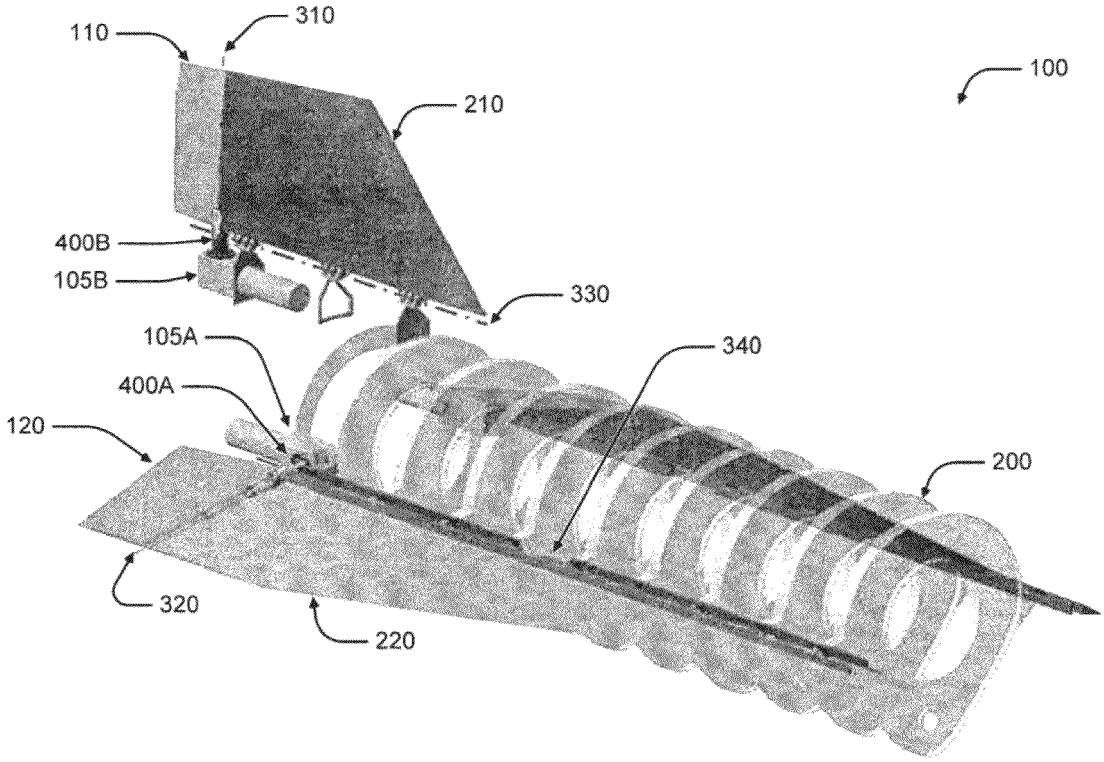
FIG. 2 illustrates a missile having a deployable wing and fin in a deployed position, in accordance with various aspects of the subject technology.

FIG. 2 illustrates the missile having the deployable wing 220 and fin 210 in a deployed position, in accordance with various aspects of the subject technology. The deployable wing 220 is configured to rotate about a wing hinge axis 340 from the stowed position to the deployed position. The deployable fin 210 is configured to rotate about a fin hinge axis 330 from the stowed position to the deployed position.

In some aspects, each control surface 110, 120 is coupled to the respective actuator 105A and 105B via the respective double joint 400A and 400B and is rotated by the respective actuator 105A and 150B about an axis. For example, actuator 105A may be coupled to the elevon 120 via double joint 400A. Actuator 105A may be configured to rotate the elevon 120 about an elevon hinge axis 320. In addition, actuator 105B may be coupled to the rudder 110 via double joint 400B. Actuator 105B may be configured to rotate the rudder 110 about a rudder hinge axis 310.

Figure 3:
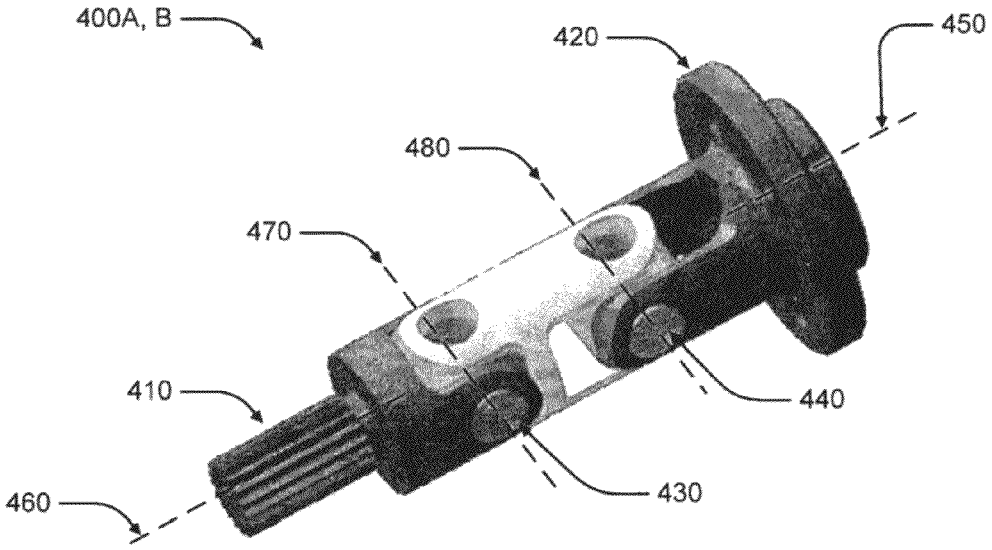
FIG. 3 illustrates a double joint, in accordance with various aspects of the subject technology.

FIG. 3 illustrates one of the double joints 400A, 400B, in accordance with various aspects of the subject technology. In some aspects, the double joint 400A, 400B may be manufactured from high temperature alloys, such as Titanium or Inconel. The double joint 400A, 400B may comprise a distal end 420 for connecting to the respective actuator 105A, 105B (not shown) and a proximal end 410 for engaging the respective control surface 110, 120 (not shown). The distal end 420 may, for example, comprise a flange configured to bolt to a corresponding flange on the actuator 105A, 105B and have an axis 450 that aligns to a rotating axis of the actuator 105A, 105B. The proximal end 410 may, for example, comprise a spline configured to engage a corresponding cavity in the control surface 110, 120 and have a spline axis 460 that aligns with the elevon hinge axis 320 (not shown) or rudder hinge axis 310 (not shown).

The spline may, for example, comprise a plurality of longitudinal projections disposed along an outer circumference of the proximal end 410. The plurality of longitudinal projections may be configured to engage corresponding slots within the control surface 110, 120, thereby enabling rotational actuation of the control surface 110, 120 along the spine axis 460. In some aspects, the spline is further configured to allow the plurality of longitudinal projections to slide longitudinally within the corresponding slots.

In one aspect, the spline engagement between the control surface 110, 120 and the double joint 400A, 400B allows the control surface 110, 120 to move longitudinally along the spline axis 460, thereby accommodating thermal expansion of the deployable wing 220 (not shown), fin 210 (not shown), or control surface 110, 120, without inhibiting actuation of the control surface 110, 120 by the respective actuator 105A, 105B. For example, as the actuator 105A, 105B and the double joint 400A, 400B rotates, the spline at the proximal end 410 causes the control surface 110, 120 to rotate about the spline axis 460. If the control surface 110, 120 thermally expands, the thermal expansion may be accommodated by allowing the control surface 110, 120 to move longitudinally, either proximally or distally, along the spline axis 460, thereby preventing binding of the control surface 110, 120 that may otherwise occur due to the thermal expansion.

Figure 4A:
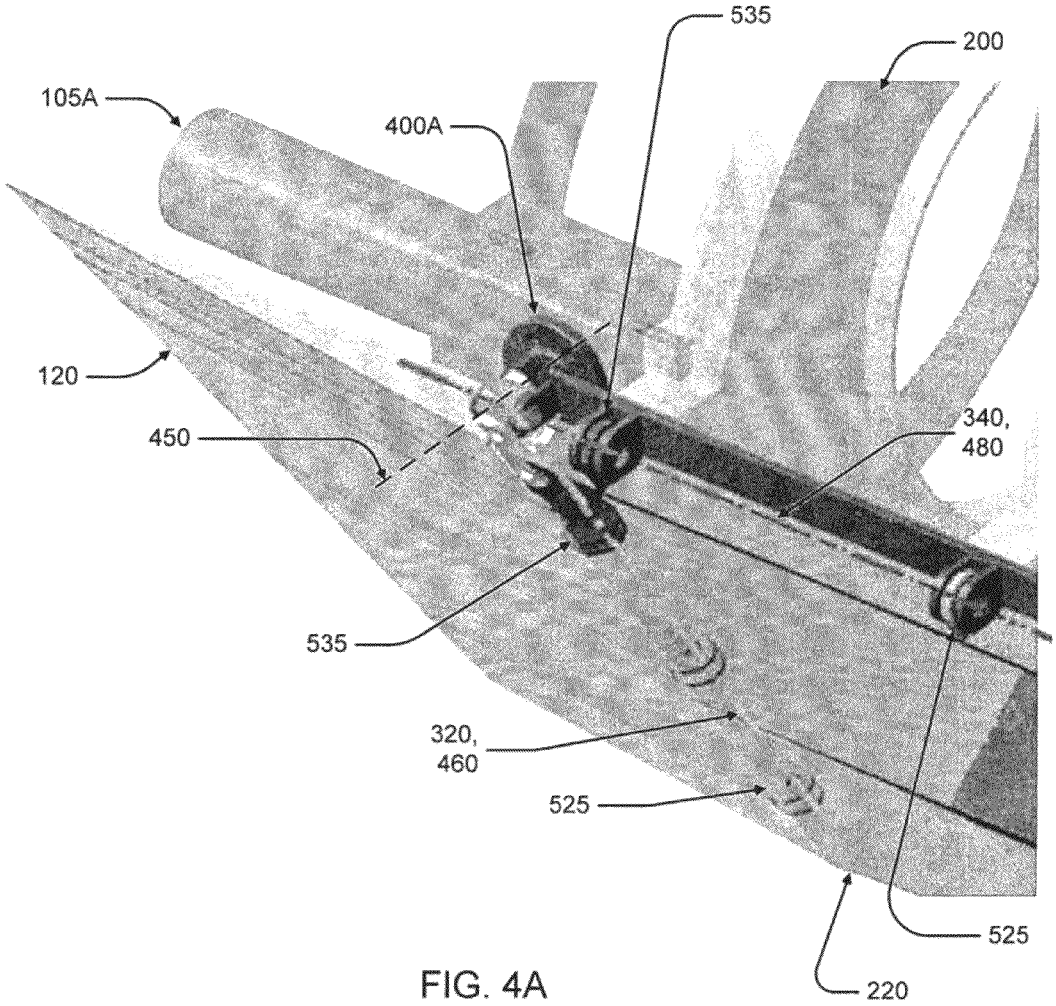
FIG. 4A illustrates a detailed view of a deployable wing in a stowed position, in accordance with various aspects of the subject technology.

In some aspects, the double joint 400A, 400B may comprise a first and second pivot, 440 and 430, respectively. The first pivot 440 may pivot about a first pivot axis 480 and the second pivot 430 may pivot about a second pivot axis 470. Referring to FIG. 4A, in one aspect, the first pivot axis 480 may be configured to align with the wing hinge axis 340 or the fin hinge axis 330 when the deployable wing or fin is in the stowed position to facilitate substantial alignment of the control surface 110, 120 with the deployable wing or fin when the wing 220 or fin 210 is in the stowed position. In some aspects, when the wing 220 or fin 210 is in the stowed position, the actuator 105A, 105B is locked by a mechanical brake disposed within the actuator housing 105A, 105B to prevent rotation of the control surface 110, 120 relative to the wing 220 or fin 210 and thereby maintain the alignment of the control surface 110, 120 relative to the wing 220 or fin 210.

In one aspect, by preventing the actuator 105A, 105B from rotating during deployment of the wing 220 or fin 210, the control surface 110, 120 maintains substantial alignment with the wing 220 or fin 210 during deployment. By preventing the actuator 105A, 105B from rotating during deployment of the wing 220 or fin 210, the first pivot axis 480 maintains the alignment with the wing hinge axis 340 or the fin hinge axis 330 throughout the deployment. The actuator 105A, 105B may, for example, be prevented from rotating with the mechanical brake.

Referring to FIG. 3, in another aspect, once deployed, the first pivot 440 and the second pivot 430 may permit the spline axis 460 to be offset from the actuator axis 450, thereby accommodating any misalignment that may occur between the deployable wing or fin and the control surface 110, 120, as may be caused by thermal expansion, bending or deflection of the deployable wing, fin, or control surface 110, 120. For example, by providing two pivot points, the spline axis 460 and the actuator axis 450 may lay in different substantially parallel planes, thereby accommodating for any misalignment that may occur between the deployable wing 220 or fin 210 and the control surface 120, 110, as may be caused by thermal expansion, bending or deflection of the deployable wing 220, fin 210, or control surface 120, 110.

In one aspect, a compliant connection point 525 may be used to connect the control surface 110, 120 to the deployable wing or fin. Referring to FIG. 4A, the compliant connection point 525 may, for example, comprise a pin or dowel to clevis connection, whereby the pin and clevis are configured with sufficient clearance with each other to allow a longitudinal degree of freedom. The compliant connection point 525 thereby allows the control surface or elevon 120 to thermally expand and move longitudinally along the elevon hinge axis 320 and the spline axis 460 without binding or otherwise inhibiting rotation or actuation of the elevon 120. The elevon 120 may be connected to the deployable wing 220 via a plurality of compliant connection points 525 that all allow for longitudinal movement of the elevon 120 along the elevon hinge axis 320 and the spline axis 460.

In some aspects, a fixed connection point 535 may be used to rigidly connect the elevon 120 to the deployable wing 220. The rigid connection point 535 may, for example, comprise a mechanical fastener configured to prevent a longitudinal degree of freedom, while allowing rotational movement. In some aspects, the rigid connection point 535 may be disposed adjacent to the double joint 400A. Accordingly, the rigid connection point 535 may be configured to allow the elevon 120 to rotate about the elevon hinge axis 320 and the spline axis 460, but prevent the elevon 120 from moving longitudinally along the elevon hinge axis 320 and spline axis 460.

In some aspects, the compliant connection points 525 may be disposed distal to the double joint 400A, 400B and the rigid connection point 535 to allow for longitudinal movement of the control surfaces 110, 120 along the spline axis 460.

In other aspects of the subject technology, compliant and rigid connection points may be similarly used to connect the deployable wing 220 or fin 210 to the missile fuselage structure 200, thereby allowing the deployable wing 220 or fin 210 to move longitudinally along the wing hinge axis 340 or fin hinge axis 330, respectively, as it thermally expands, bends, or deflects.

In some aspects, the control surface 110, 120 may be maintained in a positive engagement during deployment of the wing 220 or fin 210 from a stowed position to a deployed position. For example, as described above, the actuator 105A is configured to be mechanically engaged to the control surface 120 via the double joint 400A. Positive engagement of the control surface 120 during deployment of the wing 220 may be accomplished by a mechanical brake that is disposed within the actuator 105A and configured to prevent rotation of the actuator 105A during deployment of the wing 220. In this example, when the wing 220 is in the stowed position, the electrical power to the actuator 105A is removed and the mechanical brake is engaged, thereby holding the control surface 120 in a faired position, as shown in FIG. 4A. During the deployment of the wing 220, the actuator 105A is off and the mechanical brake remains engaged until the wing 220 is in the fully deployed position and locked. When the wing 220 is fully deployed and locked, electrical power is sent to the actuator 105A to release the mechanical brake and allow controlled rotation and actuation of the control surface 120.

Similarly, the actuator 105B may be configured to actuate the control surface 110 of the deployable fin 210 as described above.

Figure 4B:
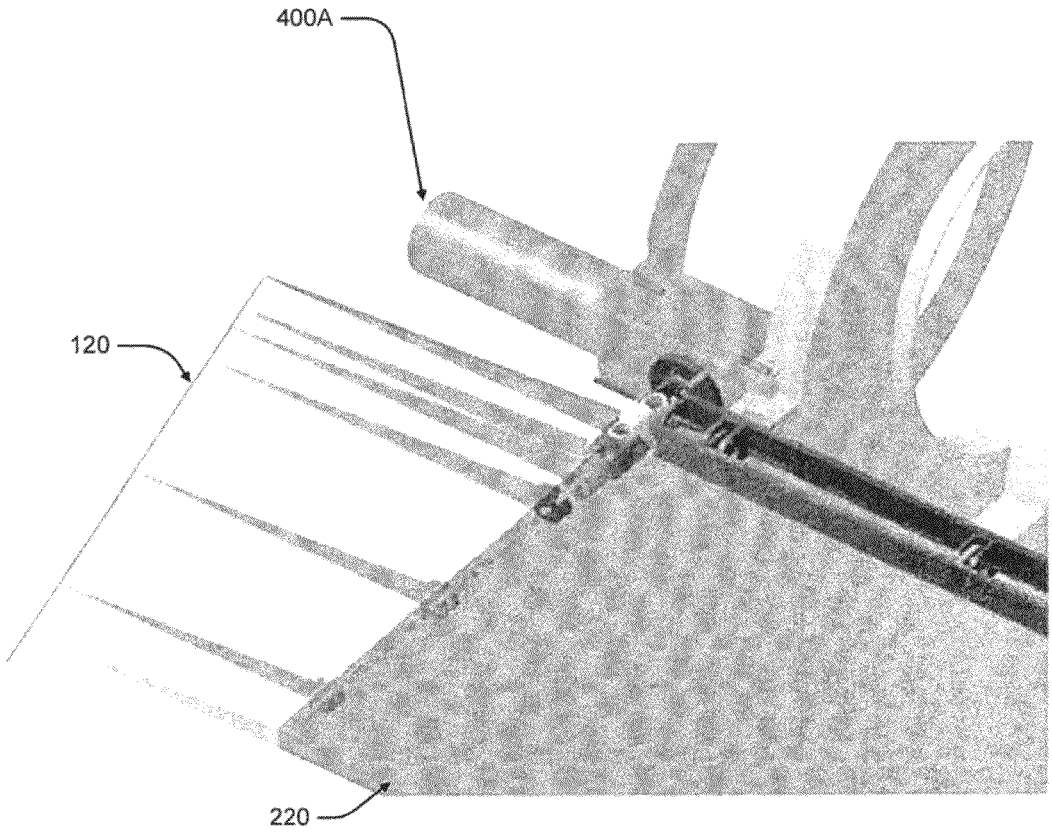
FIG. 4B illustrates a detailed view of a deployable wing in a deployed position with a control surface faired, in accordance with various aspects of the subject technology.
Figure 4C:
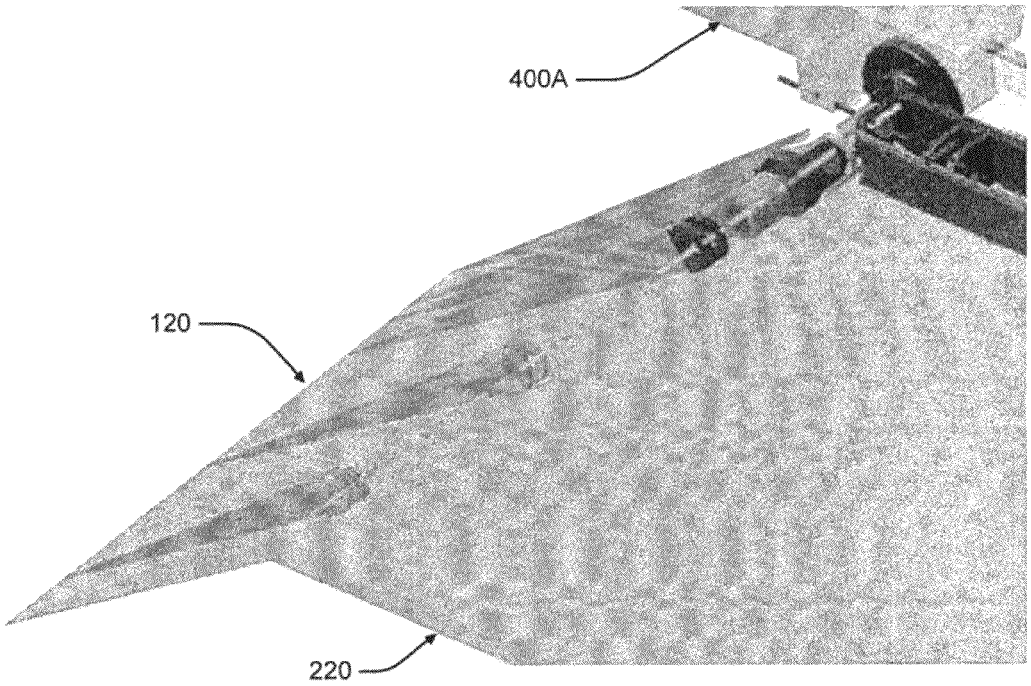
FIG. 4C illustrates a detailed view of a deployable wing in a deployed position with a control surface deflected, in accordance with various aspects of the subject technology.

FIGS. 4A, 4B and 4C illustrate detailed views of the deployable wing 220 in a stowed position, deployed position with the control surface 120 faired, and deployed position with the control surface 120 deflected, respectively, in accordance with various aspects of the subject technology. Referring to FIG. 4A, the deployable wing 220 is in the stowed position, with the control surface or elevon 120 substantially aligned with the deployable wing 220 in the faired position. The first pivot axis 480 is aligned with the wing hinge axis 340. As described above, in the stowed position, power to the actuator 105A is off, thereby activating the mechanical brake and causing the elevon 120 to be positively engaged.

During the deployment of the wing 220 about the wing hinge axis 340, from the stowed position to the deployed position, aerodynamic loads may be applied to both the wing 220 and the elevon 120. The elevon 120 may therefore experience aerodynamic and inertial moments generated about the elevon hinge axis 320. In some aspects, the double joint 400A and mechanical brake are configured to withstand the moments. For example, the mechanical brake may be configured to treat the aerodynamic load as a friction load during the wing deployment sequence, thereby resisting rotation of the elevon 120.

Referring to FIG. 4B, after the wing 220 is fully deployed and locked, the double joint 400A may be configured to provide sufficient compliance to the system 100 by accommodating wing deflection that may be caused by loads and/or thermal expansion without binding rotation of the elevon 120. For example, as described above, the first and second pivot, 440 and 430 respectively, may allow for misalignment of the spline axis 460 and the actuator axis 450 by allowing the spline axis and the actuator axis 450 to be offset from one another, on different substantially parallel planes. The spline 410 may further allow for longitudinal compliance along the spline axis 460.

Referring to FIG. 4C, after deployment of the wing 220, the elevon 120 may be rotated by the actuator as desired for proper flight of the missile. In some aspects, after the wing 220 is fully deployed, the mechanical brake may be released and the actuator may be powered to allow for controlled rotation and actuation of the elevon 120. As the elevon 120 is rotated, the first pivot axis 480 will no longer be aligned with the wing hinge axis 340, as illustrated in FIG. 4C.

Figure 5:
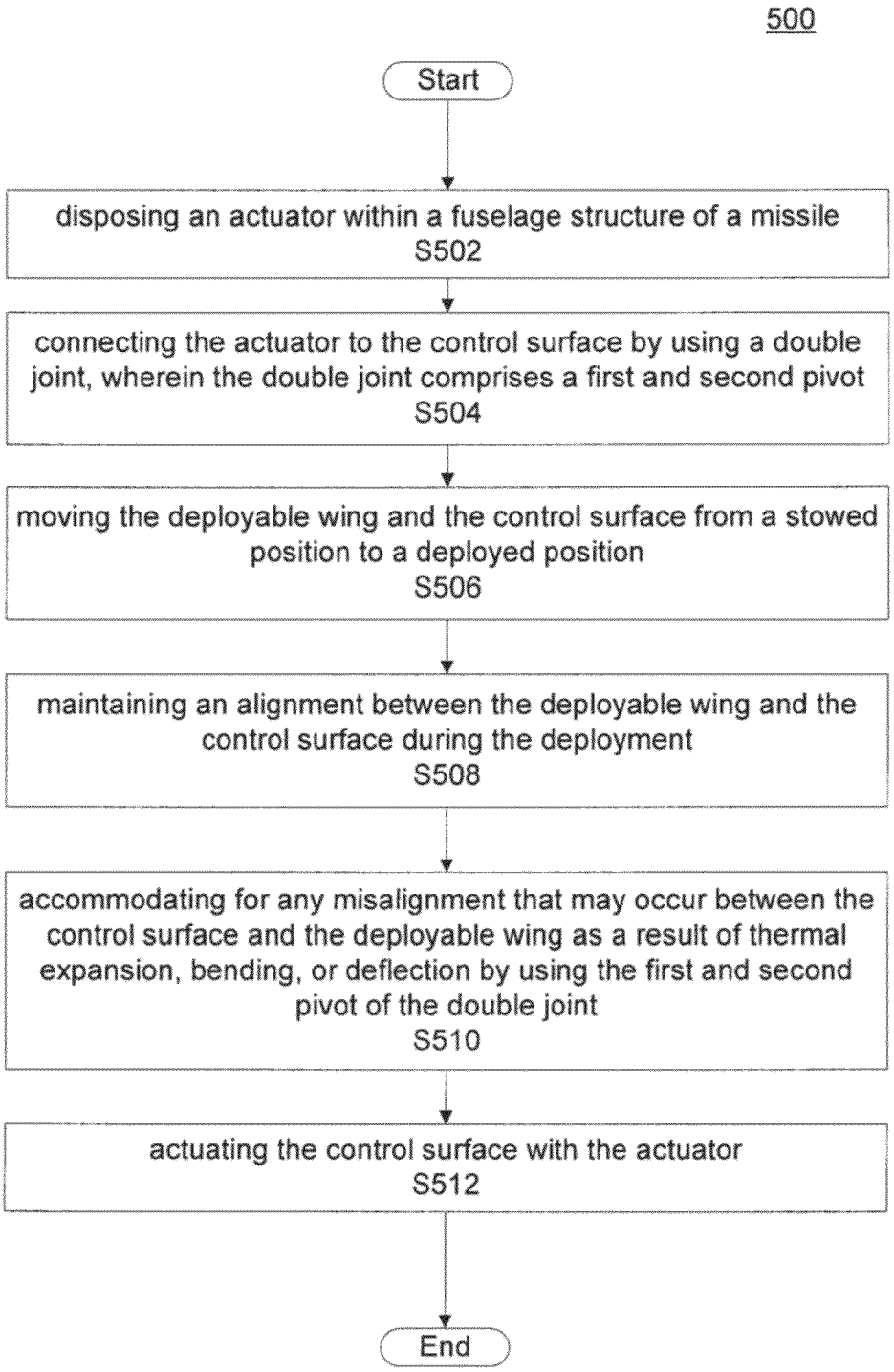
FIG. 5 illustrates a method for actuating a control surface of a deployable wing, in accordance with various aspects of the subject technology.

FIG. 5 illustrates a method 500 for actuating a control surface of a deployable wing, in accordance with various aspects of the subject technology. Method 500 comprises disposing an actuator within a fuselage structure of a missile (S502) and connecting the actuator to the control surface using a double joint, wherein the double joint comprises a first and second pivot (S504). The method also comprises moving the deployable wing and the control surface from a stowed position to a deployed position (S506) and maintaining an alignment between the deployable wing and the control surface during the deployment (S508). The method further comprises accommodating for any misalignment that may occur between the control surface and the deployable wing as a result of thermal expansion, bending, or deflection by using the first and second pivot of the double joint (S510) and actuating the control surface with the actuator (S512).

The foregoing description is provided to enable a person skilled in the art to practice the various configurations described herein. While the subject technology has been particularly described with reference to the various figures and configurations, it should be understood that these are for illustration purposes only and should not be taken as limiting the scope of the subject technology.

There may be many other ways to implement the subject technology. Various functions and elements described herein may be partitioned differently from those shown without departing from the scope of the subject technology. Various modifications to these configurations will be readily apparent to those skilled in the art, and generic principles defined herein may be applied to other configurations. Thus, many changes and modifications may be made to the subject technology, by one having ordinary skill in the art, without departing from the scope of the subject technology.

It is understood that the specific order or hierarchy of steps in the processes disclosed is an illustration of exemplary approaches. Based upon design preferences, it is understood that the specific order or hierarchy of steps in the processes may be rearranged. Some of the steps may be performed simultaneously. The accompanying method claims present elements of the various steps in a sample order, and are not meant to be limited to the specific order or hierarchy presented.

Terms such as "top," "bottom," "front," "rear" and the like as used in this disclosure should be understood as referring to an arbitrary frame of reference, rather than to the ordinary gravitational frame of reference. Thus, a top surface, a bottom surface, a front surface, and a rear surface may extend upwardly, downwardly, diagonally, or horizontally in a gravitational frame of reference.

A phrase such as an "aspect" does not imply that such aspect is essential to the subject technology or that such aspect applies to all configurations of the subject technology. A disclosure relating to an aspect may apply to all configurations, or one or more configurations. A phrase such as an aspect may refer to one or more aspects and vice versa. A phrase such as an "embodiment" does not imply that such embodiment is essential to the subject technology or that such embodiment applies to all configurations of the subject technology. A disclosure relating to an embodiment may apply to all embodiments, or one or more embodiments. A phrase such an embodiment may refer to one or more embodiments and vice versa.

Furthermore, to the extent that the term "include," "have," or the like is used in the description or the claims, such term is intended to be inclusive in a manner similar to the term "comprise" as "comprise" is interpreted when employed as a transitional word in a claim.

The word "exemplary" is used herein to mean "serving as an example, instance, or illustration." Any embodiment described herein as "exemplary" is not necessarily to be construed as preferred or advantageous over other embodiments.

A reference to an element in the singular is not intended to mean "one and only one" unless specifically stated, but rather "one or more." The term "some" refers to one or more. Underlined and/or italicized headings and subheadings are used for convenience only, do not limit the subject technology, and are not referred to in connection with the interpretation of the description of the subject technology. All structural and functional equivalents to the elements of the various configurations described throughout this disclosure that are known or later come to be known to those of ordinary skill in the art are expressly incorporated herein by reference and intended to be encompassed by the subject technology. Moreover, nothing disclosed herein is intended to be dedicated to the public regardless of whether such disclosure is explicitly recited in the above description.

What is claimed is:

1. A system for actuating a control surface of a deployable member, the system comprising:

an actuator disposed within a fuselage structure of a missile;

a double joint comprising a distal end for connecting to the actuator and a proximal end for engaging the control surface, wherein the double joint further comprises a first pivot and a second pivot, the distal end configured to pivot about a first pivot axis formed by the first pivot and the proximal end configured to pivot about a second axis formed by the second pivot, the first pivot configured to pivot about the second pivot axis and the second pivot configured to pivot about the first pivot axis; and a mechanical brake configured to controllably prevent rotation of the actuator.

2. The system of claim 1, wherein the distal end of the double joint comprises a flange for connecting to the actuator.

3. The system of claim 1, wherein the proximal end of the double joint comprises a spline configured to engage the control surface and allow the control surface to thermally expand without inhibiting actuation of the control surface.

4. The system of claim 1, wherein the first pivot of the double joint is configured to allow the control surface to move with the deployable member from a stowed position to a deployed position such that the control surface is substantially aligned with the deployable member during the deployment.

5. The system of claim 1, wherein the second pivot of the double joint is configured to accommodate for any misalignment that may occur between the control surface and the deployable member as a result of thermal expansion, bending, or deflection.

6. The system of claim 1, the system further comprising a compliant connection point for connecting the control surface to the deployable member, wherein the compliant connection point allows the control surface to thermally expand without inhibiting actuation of the control surface.

7. The system of claim 6, wherein the compliant connection point is disposed distal to the double joint.

8. The system of claim 1, wherein the missile is a supersonic missile.

9. The system of claim 1, wherein the deployable member comprises a deployable wing.

10. The system of claim 1, wherein the deployable member comprises a deployable fin.

* * * * *